US007872739B2

(12) United States Patent
Tomita et al.

(10) Patent No.: US 7,872,739 B2
(45) Date of Patent: Jan. 18, 2011

(54) RUDDER ANGLE DETECTING DEVICE OF STEERING GEAR

(75) Inventors: Yukio Tomita, Osaka (JP); Kenjiro Nabeshima, Osaka (JP); Takayuki Wakabayashi, Osaka (JP); Hirotaka Yamamoto, Osaka (JP)

(73) Assignee: Japan Hamworthy & Co., Ltd. (JP)

( * ) Notice: Subject to any disclaimer, the term of this patent is extended or adjusted under 35 U.S.C. 154(b) by 463 days.

(21) Appl. No.: 12/107,866

(22) Filed: Apr. 23, 2008

(65) Prior Publication Data

US 2008/0278714 A1 Nov. 13, 2008

(30) Foreign Application Priority Data

May 9, 2007 (JP) ..... 2007-124021

(51) Int. Cl.
*G01B 11/26* (2006.01)

(52) U.S. Cl. ..... 356/138

(58) Field of Classification Search ..... None
See application file for complete search history.

(56) References Cited

U.S. PATENT DOCUMENTS 4,129,087 A * 12/1978 Dimmick et al. ..... 114/144 E
5,107,424 A * 4/1992 Bird et al. ..... 701/21
5,361,024 A * 11/1994 Wisner et al. ..... 318/588
6,311,634 B1 * 11/2001 Ford et al. ..... 114/144 R
6,549,831 B2 * 4/2003 Thompson ..... 701/21
2003/0108222 A1 * 6/2003 Sato et al. ..... 382/104
2006/0000969 A1 * 1/2006 Sano ..... 250/231.13

FOREIGN PATENT DOCUMENTS

JP 11-255197 9/1999

* cited by examiner

*Primary Examiner*—Gregory J Toatley
*Assistant Examiner*—Juan D Valentin
(74) *Attorney, Agent, or Firm*—Kusner & Jaffe

(57) ABSTRACT

The inner cylindrical body is mounted on the top surface of the rudder-stock; the outer cylindrical body is put on the inner cylindrical body exteriorly; the gudgeon pin provided on the top reverse surface of the outer cylindrical body is inserted into the gudgeon provided on the top surface of the inner cylindrical body; the pin protruded on the top surface of the outer cylindrical body is inserted into the chest fixated to the supports; the rotational movement checking device, that obstructs the pin to rotate, and at the same time, permits it to be displaced in the radial direction, is provided inside the chest; the scale is provided on the outer circumferential surface of the inner cylindrical body; and, the rudder angle detecting optical sensors facing the scale are mounted on the inner circumferential surface of the outer cylindrical body.

4 Claims, 10 Drawing Sheets

RUDDER ANGLE DETECTING DEVICE OF STEERING GEAR

FIELD OF THE INVENTION

The present invention is concerned with a rudder angle detecting device equipped to a steering gear of a ship.

BACKGROUND OF THE INVENTION

A control device of a steering gear of a ship is generally composed as follows; namely, as shown in FIG. 10, an auto-pilot steering apparatus 51 has two steering order systems of an automatic steering system 52 and a hand steering system 53; a steering gear 55 for operating a rudder 54 is operated by a No. 1 hydraulic pump unit 56*a* or a No. 2 hydraulic pump unit 56*b*, respectively provided independently; and the No. 1 hydraulic pump unit 56*a* and the No. 2 hydraulic pump unit 56*b* are controlled by a No. 1 control amplifier 57*a* and a No. 2 control amplifier 57*b*, respectively.

An actual turning angle of the rudder 54, namely, the steering gear 55, is detected by a No. 1 rudder angle detector 58*a* and a No. 2 rudder angle detector 58*b*, respectively, and a signal of an actual turning angle is fed back to the No. 1 control amplifier 57*a* and the No. 2 control amplifier 57*b*, respectively, for follow-up control. In this context, the No. 1 control amplifier 57*a* can be changed over for controlling the No. 2 hydraulic pump unit 56*b*, and the No. 2 control amplifier 57*b* can be changed over for controlling the No. 1 hydraulic pump unit 56*a*.

Furthermore, as other means of controlling the steering gear 55, a non-follow-up steering system 59 for operating the No. 1 control amplifier 57*a* and the No. 2 control amplifier 57*b* without follow-up control directly from a bridge, and a device for manually operating the No. 1 hydraulic pump unit 56*a* and the No. 2 hydraulic pump unit 56*b* at the steering gear site are provided. Besides, an actual turning angle of the rudder 54 is detected by a rudder angle transmitter 60, and indicated at a rudder angle indicator 61.

When a certain rudder angle order signal $\delta i$ is emitted from the automatic steering system 52 or the hand steering system 53 of the auto-pilot steering apparatus 51, this signal is input into the No. 1 control amplifier 57*a* or the No. 2 control amplifier 57*b* wherein this signal is amplified and a control signal $\delta c$ is output. The control signal $\delta c$ controls the No. 1 hydraulic pump unit 56*a* or the No. 2 hydraulic pump unit 56*b*, and operates the steering gear 55 and the rudder 54.

A turning angle of the rudder 54, namely, the steering gear 55, is detected by the No. 1 rudder angle detector 58*a* and the No. 2 rudder angle detector 58*b*, and the turning angle signal is fed back to the No. 1 control amplifier 57*a* and the No. 2 control amplifier 57*b*, respectively, as a rudder angle feed-back signal $\delta f$. Respectively in the No. 1 control amplifier 57*a* and the No. 2 control amplifier 57*b*, the rudder angle order signal $\delta i$ and the rudder angle feed-back signal $\delta f$ are compared, and, when it comes to such a state as $\delta i = \delta f$, the No. 1 control amplifier 57*a* or the No. 2 control amplifier 57*b* stops operation of the No. 1 hydraulic pump unit 56*a* or the No. 2 hydraulic pump unit 56*b*, and the steering gear 55, namely, the rudder 54, is held at the ordered rudder angle (namely, the rudder angle corresponding to the rudder angle order signal $\delta i$).

In the aforementioned control device of a steering gear 55, rudder angle detecting mechanism is composed as shown in FIG. 11~FIG. 13 in case of a rotary vane type steering gear. Namely, a steering gear rotor 63 that is a body rotating together with a rudder-stock 62 is bound with the rudder-stock 62, and the binding is fixated by a nut 64. On the upper surface of the nut 64, a stand 65 is provided, the turning center CS of which coincides with the axis CR of the rudder-stock 62, and a yoke 66 is fitted on the upper surface of the stand 65. The yoke 66 has two ramifications 66*a*, 66*b*.

On the other hand, a casing top cover 67 of the steering gear 55, which is an unrotating structural body, fixedly holds on its surface the No. 1 rudder angle detector 58*a* and the rudder angle transmitter 60 so that they are operated by the first ramification 66*a* of the yoke 66, and the No. 2 rudder angle detector 58*b* so that it is operated by the second ramification 66*b* of the yoke 66, respectively. A yoke pin 68 is provided at a pointed end of the first ramification 66*a* of the yoke 66, the yoke pin 68 being connected with a pointed end of a lever 69 of the No. 1 rudder angle detector 58*a* by a connecting rod 70, and at the same time, the yoke pin 68 being connected with a pointed end of a lever 71 of the rudder angle transmitter 60 by a connecting rod 72. Furthermore, a yoke pin 73 is provided at a pointed end of the second ramification 66*b* of the yoke 66, the yoke pin 73 being connected with a pointed end of a lever 74 of the No. 2 rudder angle detector 58*b* by a connecting rod 75.

As shown in FIG. 11, turning arm length of the yoke pin 68 (namely, distance from the turning center CS to the center of the yoke pin 68) is same as the length of the lever 69 of the No. 1 rudder angle detector 58*a*, and the length of the lever 71 of the rudder angle transmitter 60. Furthermore, turning arm length of the yoke pin 73 (namely, distance from the turning center CS to the center of the yoke pin 73) is same as the length of the lever 74 of the No. 2 rudder angle detector 58*b*. The respective connecting rods 70, 72, 75 are of such construction as to be adjustable of the connecting length, and hereby adjustment is conducted so that the turning arm of the yoke pin 68 (namely, the first line L1 passing through the turning center CS and the center of the yoke pin 68) becomes parallel with the lever 69 of the No. 1 rudder angle detector 58*a*, and the lever 71 of the rudder angle transmitter 60, respectively, and that the turning arm of the yoke pin 73 (namely, the second line L2 passing through the turning center CS and the center of the yoke pin 73) becomes parallel with the lever 74 of the No. 2 rudder angle detector 58*b*.

In this context, in case of a ram-type or a piston-type steering gear, such a yoke is provided on a rudder-stock or a tiller, and rudder angle detectors and a rudder angle transmitter are provided on a deck, but mechanism of connecting both is similar to that of the case of a rotary vane type steering gear aforementioned.

Furthermore, the steering gear 55 is provided with limit switches that independently function for the No. 1 control amplifier 57*a* and the No. 2 control amplifier 57*b*, respectively, so that the rudder 54 is prevented from moving beyond the respective maximum rudder angles limits by reason of erroneous function of feed-back control mechanism, etc. In case that it is so arranged that the steering gear 55 works within the maximum rudder angle limits of 35°-45° port and 35°-45° starboard, for example, for navigation mode, and within the maximum rudder angle limits of 70° port and 70° starboard, for example, for harbor operation mode, the respective limit switches for limiting a rudder angle at 35°-35° (or 45°-45°) and the respective limit switches for limiting a rudder angle at 70°-70° are independently provided. And, though figuring is omitted, these limit switches are randomly arranged at exteriorly exposed moving portions of the steering gear 55.

The rotary vane steering gear 55 makes it one of special characters as inherent properties of its main body that no protruded moving portion exteriorly exposes, which makes safe operation possible, and that it gives excellent aesthetic sense with its simple cylindrical external form. However, the steering gear 55 necessitates that the mechanism for detecting a rudder angle (including the limit switches) is appended to the main body of the steering gear 55, and, with a conventional manner, as shown in FIG. 11-FIG. 13, there have been such problems that these appendages form the protruded moving portions exteriorly exposed (the yoke 66, the levers 69, 71, 74, the connecting rods 70, 72, 75, etc.), which spoil the features of safe operation and the aesthetic sense inherent in the steering gear 55. Furthermore, there have been such ill-conditions that the aforementioned mechanism for detecting a rudder angle (including the limit switches) is apt to be affected by contaminated environment, and happens to cause ill-operation by an accidental mechanical blow sustained during work because of its exposure to the exterior of the steering gear 55.

Furthermore, in the aforementioned constitution, when the casing top cover 67 is removed, or the nut 64 that fixates bond between the rudder-stock 62 and the steering gear rotor 63 is removed and fitted, for overhaul inspection of the steering gear 55, the connection between the yoke 66 and the respective rudder angle detectors 58*a*, 58*b* and rudder angle transmitter 60 must be disconnected by removing the connecting rods 70, 72, 75. Accordingly, when they are re-assembled, in order to make it possible that a rudder angle is accurately transmitted to the rudder angle detectors 58*a*, 58*b* and the rudder angle transmitter 60, length of the respective connecting rods 70, 72 must have been minutely adjusted, so that the No. 1 rudder angle detector lever 69 and the rudder angle transmitter lever 71 come to accurately parallel the aforementioned first line L1, collating with an actually indicated rudder angle, with the steering gear 55 being operated. Similarly, length of the connecting rod 75 must have been minutely adjusted so that the No. 2 rudder angle detector lever 74 comes to accurately parallel the aforementioned second line L2, collating with an actually indicated rudder angle, with the steering gear 55 being operated. Such work for adjusting length of the respective connecting rods 70, 72, 75 is considerably troublesome, and there has been a problem that the re-assembling/re-adjusting work requires much labor and time.

Furthermore, in case that it is required for the steering gear 55 to take a large rudder angle (for example, 70° port and 70° starboard), there has been a problem that, in the condition of the 70° rudder angle (a large rudder angle), accurate transmission of a rudder angle to the rudder angle detectors 58*a*, 58*b* and the rudder angle transmitter 60 becomes hard because, with a large rudder angle, an angle made by the connecting rod 70 and the No. 1 rudder angle detector lever 69, and an angle made by the connecting rod 72 and the rudder angle transmitter lever 71, and an angle made by the connecting rod 75 and the No. 2 rudder angle detector lever 74 becomes small geometrically to the extreme degree, and furthermore, adjustment of length of the connecting rods 70, 72, 75 becomes further troublesome and delicate for such a large rudder angle.

Furthermore, in the light of such a phenomenon that there is a case that the rudder-stock 62 suffers off-centering motion by reason of abrasion of an upper radial bearing 76 provided between the rotor 63 and the casing top cover 67 of the steering gear 55 or a lower radial bearing (illustration is omitted), and ill-alignment at installation work, etc., a certain consideration is given design-wise so that the connection between the moving portions and the stationary portions in the rudder angle detecting mechanism allows such off-centering motion. There has been a problem, however, that enlargement of a rudder angle detecting error by off-centering motion is unavoidable.

The present invention resolves the aforementioned problems and aims at offering such a rudder angle detecting device of a steering gear as to make possible of safe operation of a steering gear by dispensing with protrusive moving portions that exteriorly protrude from a steering gear; make a steering gear excellent in aesthetic sense inherent in a rotary vane type steering gear; make troublesome readjusting work for detecting a rudder angle unnecessary at the time of overhaul inspection and reassembling of a steering gear; make a degree of the precision of detecting a rudder angle unvaried regardless of magnitude of a rudder angle; dispense with hardness of adjustment for detecting a large rudder angle; and furthermore, bring no ill-condition in the rudder angle detecting mechanism and is correctly detectable of a rudder angle even in case of off-centering motion of a rudder-stock.

SUMMARY OF THE INVENTION

The first invention of a rudder angle detecting device of a steering gear in the present invention is characterized in that: an inner cylindrical body is mounted on the top surface of a rudder-stock coaxially with the rudder-stock;

an outer cylindrical body is put on the inner cylindrical body exteriorly;

a rotational movement checking device is provided for obstructing rotational movement of the outer cylindrical body in the direction of rotation of the rudder-stock;

a scale is provided on the outer circumferential surface of the inner cylindrical body;

the scale is provided with graduations in the fixed circumferential pitch; and rudder angle detecting optical sensors that read the graduations are mounted on the inner circumferential surface of the outer cylindrical body.

Thanks to the aforementioned constitution in accordance with the present invention, the inner cylindrical body rotates together with the rudder-stock when the rudder-stock rotates, and on this occasion, the outer cylindrical body is obstructed to rotate by means of the rotational movement checking device, and a rudder angle is detected by means that the rudder angle detecting optical sensors read the graduations of the scale.

As the scale, the rudder angle detecting optical sensors, and the inner cylindrical body are mounted inside the outer cylindrical body, the steering gear can dispense with protrusive moving portions that exteriorly protrude from the steering gear, and safe operation of the steering gear becomes possible. Furthermore, the steering gear becomes excellent in aesthetic sense because an external form of the steering gear becomes a simple columnar body as a whole. Furthermore, the rudder angle detecting mechanism becomes hard to be affected by contaminated environment, and that such an occasion that it falls into ill-operation by reason of an accidental mechanical blow sustained during work, etc. is decreased as it is not exposed to the outside.

The second invention of a rudder angle detecting device of a steering gear in the present invention is characterized in that: a gudgeon is provided on the top surface of the inner cylindrical body;

the gudgeon holds a concave portion;

a collar is protruded on the lower outer circumferential surface of the inner cylindrical body;

a gudgeon pin is provided in the center of the top reverse surface of the outer cylindrical body;

the gudgeon pin is inserted into the concave portion of the gudgeon, and slidingly contacts with the gudgeon in the circumferential direction;

the outer circumferential surface of the collar slidingly contacts with the inner circumferential surface of the outer cylindrical body;

supports are mounted on a casing top cover of a steering gear;

a cylindrical chest is mounted at the end of the supports, coaxially with the casing top cover;

a pin is protruded in the center of the top surface of the outer cylindrical body so that it is inserted into the chest; and the said rotational movement checking device is provided inside the chest so that it obstructs the said pin to rotate against the chest in the rotating direction of a rudder-stock, and at the same time, permits the said pin to be displaced in the radial direction of the rudder-stock.

Thanks to the aforementioned constitution in accordance with the present invention, the inner cylindrical body rotates together with the rudder-stock when the rudder-stock rotates, and on this occasion, the outer cylindrical body is obstructed to rotate together with the pin by means of the rotational movement checking device; the gudgeon of the inner cylindrical body slidingly contacts with the gudgeon pin; and at the same time, the collar of the inner cylindrical body slidingly contacts with the outer cylindrical body; and in such conditions, a rudder angle is detected by means that the rudder angle detecting optical sensors read the graduations of the scale.

On the occasion of overhaul inspection of the steering gear, while in conventional mechanism it has been necessary that respective connecting rods are removed one by one, and after a steering gear has been reassembled, they have to be remounted, and troublesome adjustment to the rudder angle detecting mechanism is needed again, the present invention makes it possible to overhaul the casing top cover by means of removing only the supports from the casing top cover, with the rudder angle detecting device being left as it is; or, even a nut that fixates the binding between a rudder-stock and a steering gear rotor can be removed/remounted by means that the supports are removed from the casing top cover and whole the rudder angle detecting device is removed from the rudder-stock just as it is. Furthermore, it comes not to be necessitated to conduct readjustment to the rudder angle detecting device, that is troublesome in a conventional device, when reassembling the steering gear, and thus overhaul inspection work for the steering gear becomes easy.

Furthermore, the precision of detecting a rudder angle comes to be unvaried regardless of magnitude of a rudder angle, and hardness of adjustment for detecting a large rudder angle can be removed.

Furthermore, even if off-centering motion occurs at the rudder-stock and the inner cylindrical body is displaced together with the rudder-stock in the radial direction of the rudder-stock, this displacement against the supports is absorbed by the rotational movement checking device in the chest, and hence the aforementioned off-centering motion of the rudder-stock is permissible for the rudder angle detecting device, and that distance between the scale and the rudder angle detecting optical sensors is kept at the fixed interval always. Accordingly, a rudder angle can be correctly detected regardless of off-centering motion of the rudder-stock.

The third invention of a rudder angle detecting device of a steering gear in the present invention is characterized in that: a rudder angle transmitting optical sensor and a zero-point detecting optical sensor are mounted on the inner circumferential surface of an outer cylindrical body;

the rudder angle detecting optical sensors, the rudder angle transmitting optical sensor and the zero-point detecting optical sensor face the scale at the fixed intervals; and counting integrators that integrate numbers of passed graduations read by the aforementioned respective optical sensors, and transform to a rudder angle signal, are connected with the aforementioned respective optical sensors through input-output cables and a cable connector provided on the outer cylindrical body.

Thanks to the aforementioned constitution in accordance with the present invention, the steering gear can dispense with protrusive moving portions that exteriorly protrude from the steering gear since the rudder angle detecting optical sensors, the rudder angle transmitting optical sensor and the zero-point detecting optical sensor are mounted inside the outer cylindrical body. Accordingly, safe operation of the steering gear becomes possible, and at the same time, the steering gear becomes excellent in aesthetic sense, and the rudder angle detecting mechanism becomes hard to be affected by contaminated environment. Furthermore, such an occasion that the rudder angle detecting mechanism falls into ill-operation by reason of an accidental mechanical blow sustained during work, etc. is decreased.

The fourth invention of a rudder angle detecting device of a steering gear in the present invention is characterized in that: cams are provided on the outer circumferential surface of the inner cylindrical body in the location corresponding to the zero rudder angle;

limit switches are mounted on the inner circumferential surface of the outer cylindrical body in the locations corresponding to the maximum rudder angle limits; and the limit switches are actuated by the cams when rudder angles reach the maximum rudder angle limits.

Thanks to the aforementioned constitution in accordance with the present invention, when the rudder-stock rotates and has reached the maximum rudder angle limits, the limit switches are actuated by the cams, and it is detected that the rudder-stock has come to the maximum rudder angle limits. By this detection, it is possible for the rudder-stock to be stopped so as not to move beyond the maximum rudder angle limits.

Furthermore, the limit switch mechanism also exhibits similar effect to that of the aforementioned rudder angle detecting mechanism. Namely, by virtue of dispensing with protrusive moving portions that exteriorly protrude from the steering gear by means that the limit switch mechanism is mounted inside the outer cylindrical body of the rudder angle detecting device, the steering gear becomes possible of safe operation, and that it comes not to spoil its inherent excellence in aesthetic sense.

Furthermore, the limit switch mechanism comes not to be affected by contaminated environment, and that such an occasion that it falls into ill-operation by reason of an accidental mechanical blow sustained during work, etc. is decreased.

DETAILED DESCRIPTION OF PREFERRED EMBODIMENTS

In order to explain the present invention more in detail, explanation is made in accordance with the accompanying drawings.

First, the first mode for carrying out the present invention is described and illustrated below on the basis of the accompanying drawings. Regarding the same members as those explained above in the background of the invention, explanation is omitted, with the same numbers being affixed.

Figure 1:
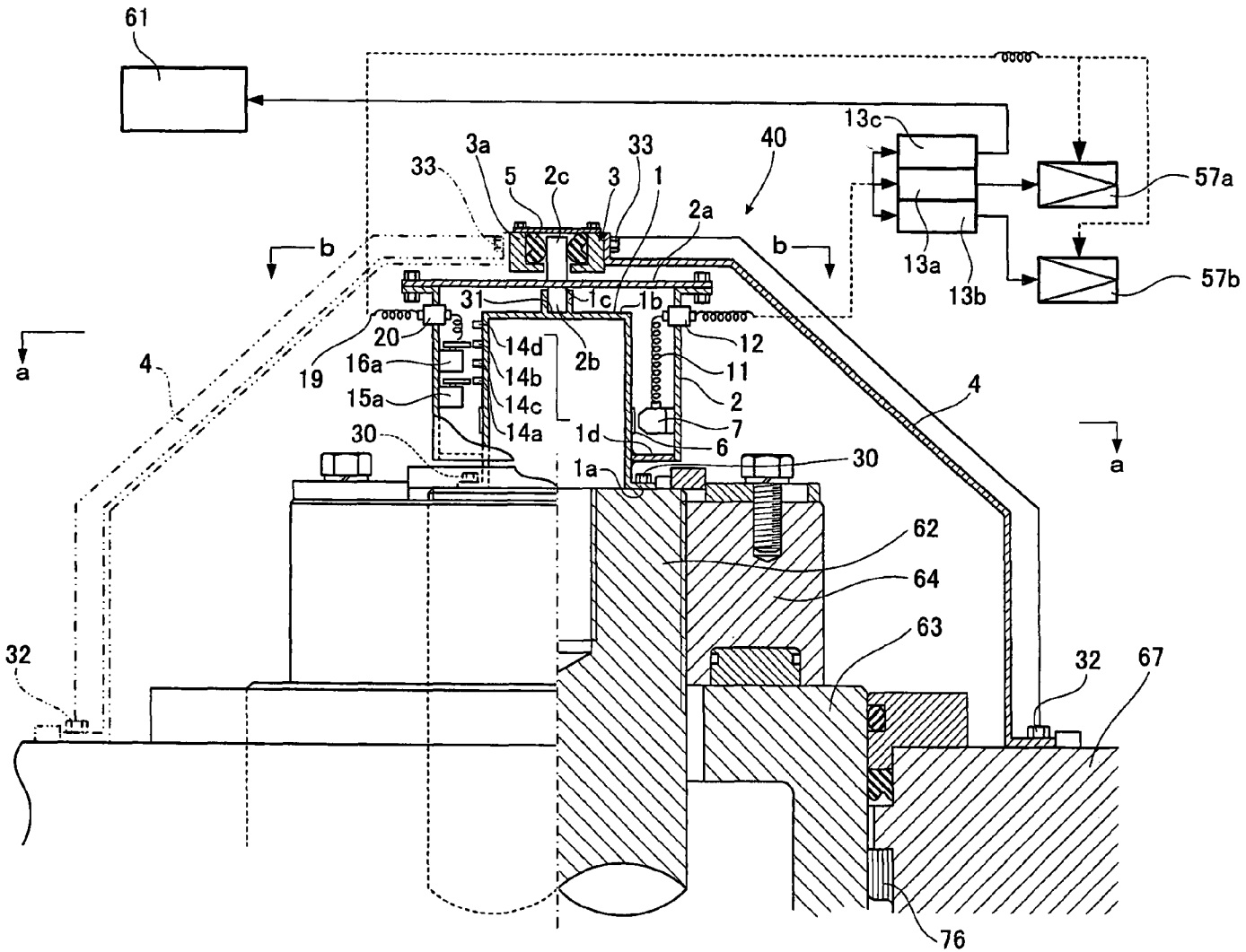
FIG. 1 shows a vertically sectioned view of a rudder angle detecting device of a steering gear in accordance with the first mode for carrying out the present invention.
Figure 2:
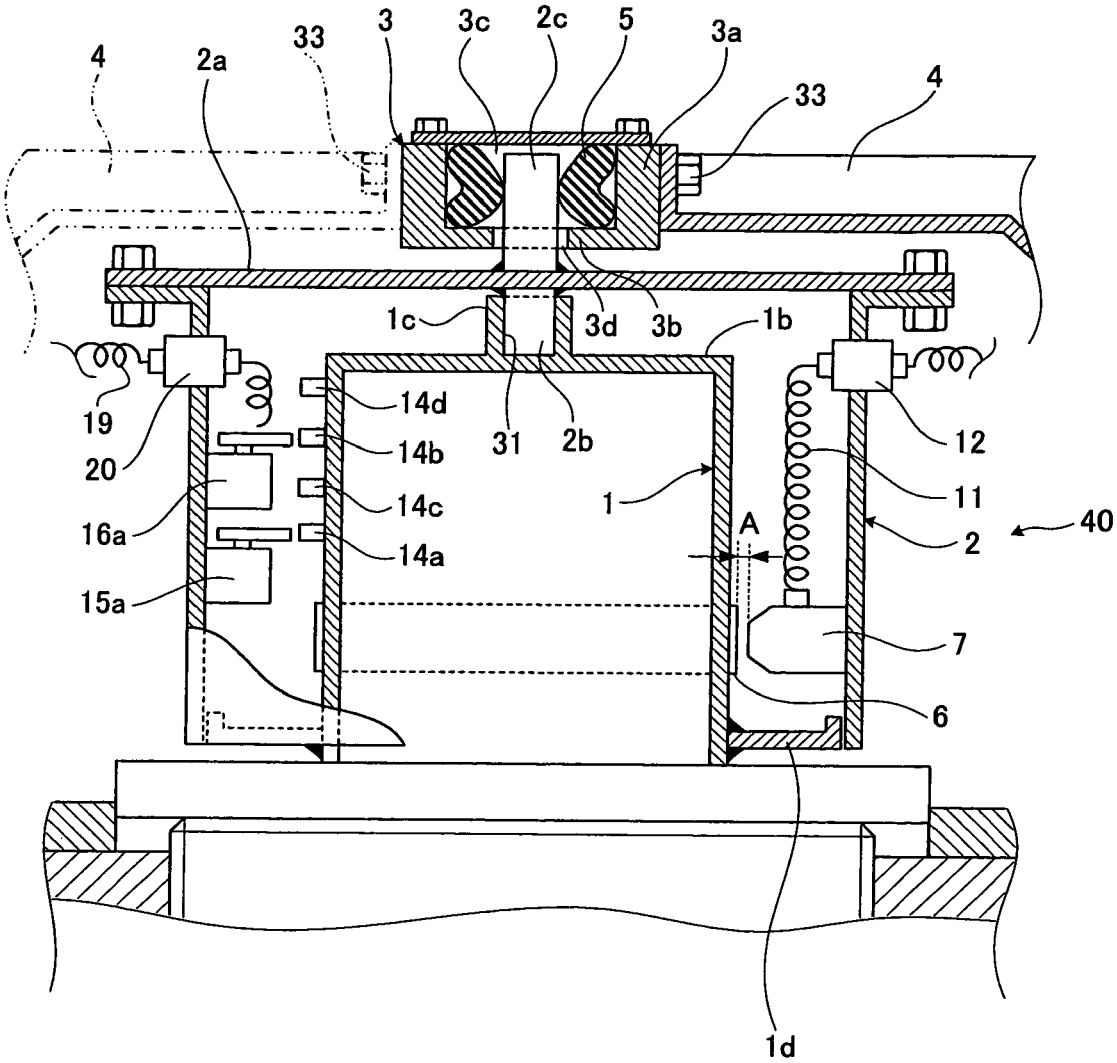
FIG. 2 shows an enlarged vertically sectioned view of a rudder angle detecting device in accordance with the first mode for carrying out the present invention.
Figure 3:
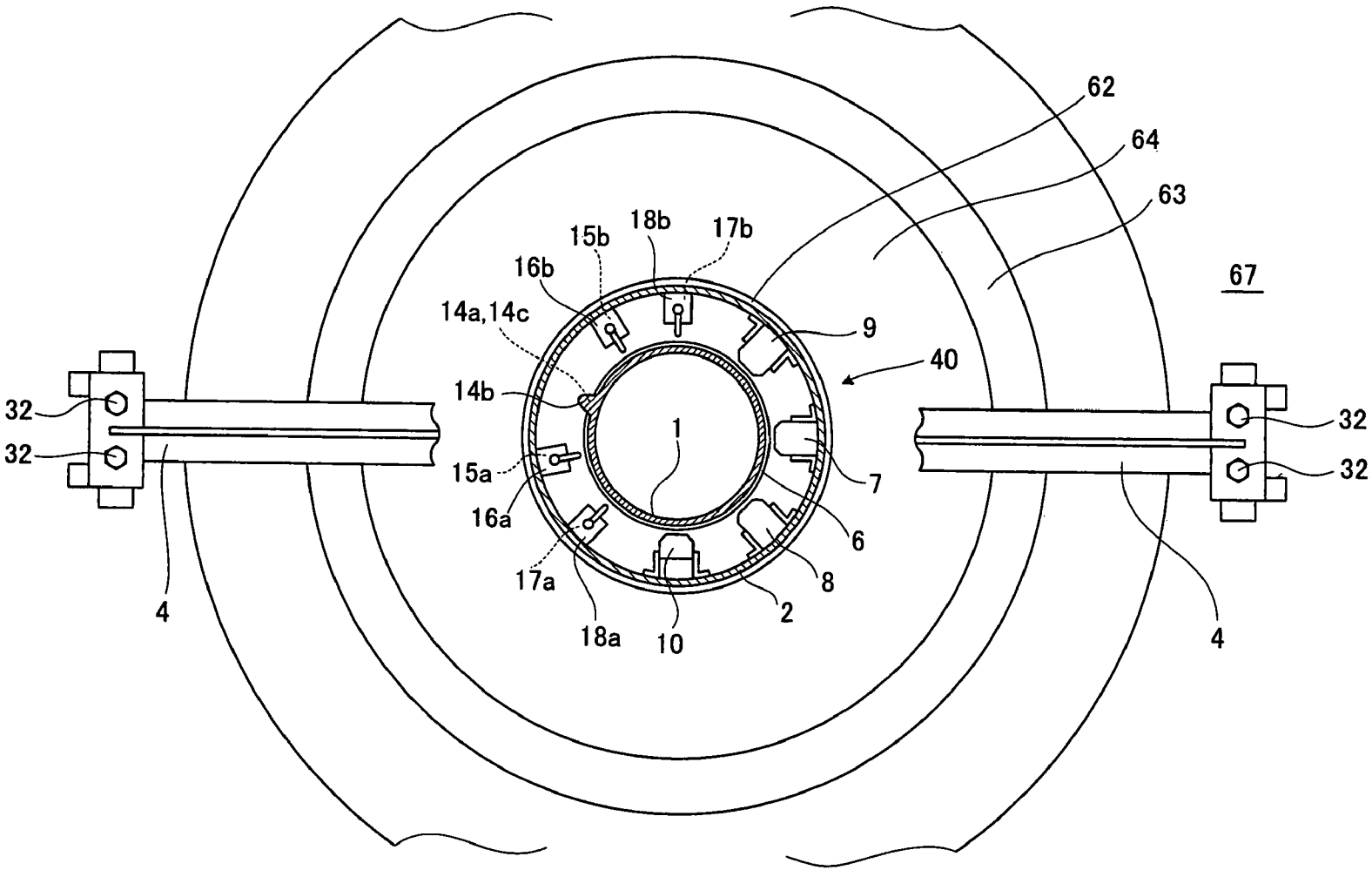
FIG. 3 shows a sectioned view, seen along the arrows a-a in FIG. 1 aforementioned.

As shown in FIG. 1~FIG. 3, an inner cylindrical body 1 is mounted on the top surface of a rudder-stock 62 coaxially with the rudder-stock 62. The inner cylindrical body 1 is provided with a flange 1*a* at the lower part, and connected to the rudder-stock 62 attachably and detachably by plural bolts 30.

The inner cylindrical body 1 is a cylindrical member, with its upper end being closed, and forming the top surface 1*b*. A cylindrical gudgeon 1*c* is provided on the top surface 1*b* of the inner cylindrical body 1 coaxially with the rudder-stock 62. The gudgeon 1*c* holds a concave portion 31 that opens upward. Furthermore, a collar 1*d* is protruded on the outer circumferential surface of the lower part, upper than the flange 1*a*, of the inner cylindrical body 1, extending over the whole circumference.

Figure 4:
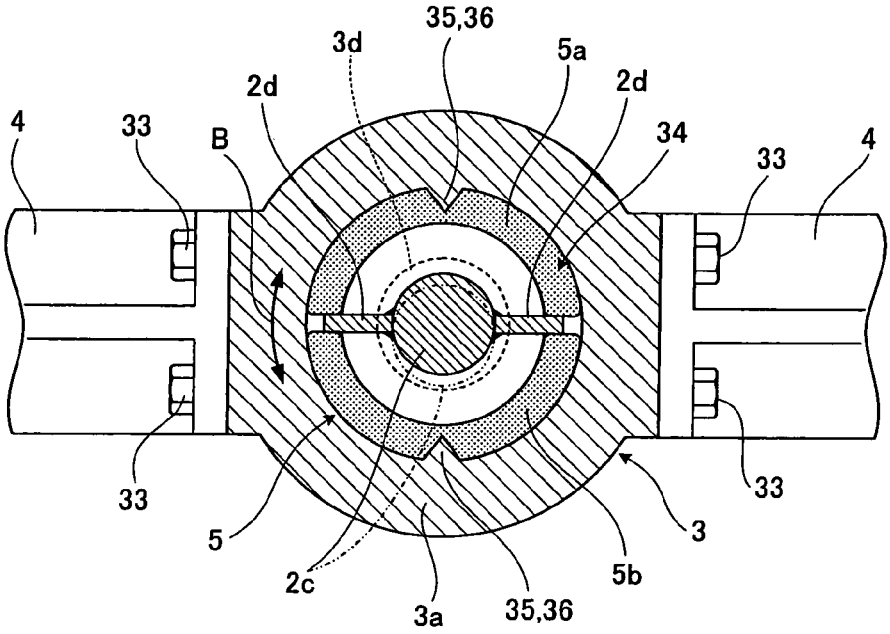
FIG. 4 shows a sectioned view, seen along the arrows b-b in FIG. 1 aforementioned.

An outer cylindrical body 2 provided with a top lid 2*a* is open in the lower end, and arranged so as to be put on the inner cylindrical body 1 coaxially with the rudder-stock 62 (namely, with the inner cylindrical body 1). The inner surface of the outer cylindrical body 2 faces the outer circumferential surface and the top surface of the inner cylindrical body 1. A gudgeon pin 2*b* protrudes on the reverse surface of the top lid 2*a* (the top reverse surface) in the downward direction coaxially with the rudder-stock 62. The gudgeon pin 2*b* is circular in the cross-sectional profile, and is inserted from the upper part into the concave portion 31 of the gudgeon 1*c* so as to slidingly contact the gudgeon 1*c* in the circumferential direction. Furthermore, the lower inner circumferential surface of the outer cylindrical body 2 slidingly contacts the outer circumferential surface of the collar 1*d* of the inner cylindrical body 1 in the circumferential direction. A pin 2*c* stands on the upper surface of the top lid 2*a* (the top surface) of the outer cylindrical body 2 coaxially with the rudder-stock 62. As shown in FIG. 4, the cross-sectional profile of the pin 2*c* is circular.

A pair of supports 4 is mounted on the upper surface of the casing top cover 64 attachably and detachably by bolts 32. A chest 3 is arranged between the respective upper end portions of both supports 4 that face each other, and the chest 3 and the supports 4 are fixedly connected attachably and detachably by bolts 33. The chest 3 is composed of a cylindrical body 3*a* that opens both upwards and downwards, a brim 3*b* that protrudes on the lower inner circumferential surface of the cylindrical body 3*a* toward the inside in the radial direction, a room 3*c* formed in the cylindrical body 3*a*, and a piercing hole 3*d* formed at the brim 3*b*.

Figure 5:
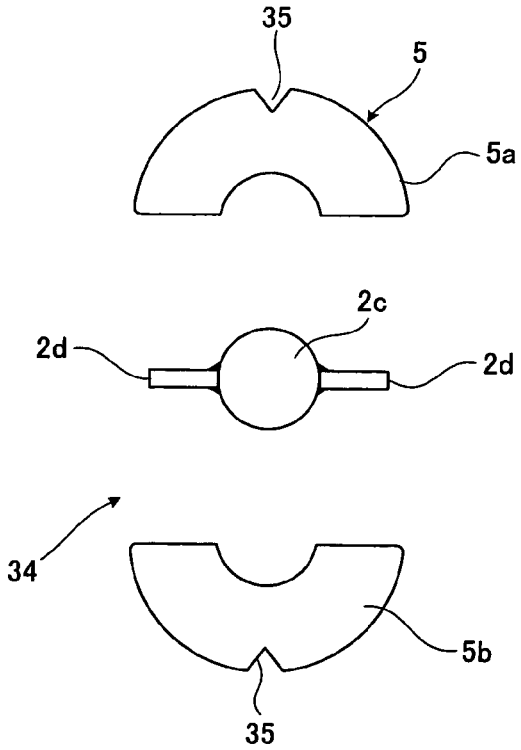
FIG. 5 shows a plane view showing constitution of a rotational movement checking device of a rudder angle detecting device in accordance with the first mode for carrying out the present invention.

The aforementioned pin 2*c* is loosely fitted into the piercing hole 3*d* of the chest 3 from the lower side, and inserted into the room 3*c*. In this context, a fixed gap is formed between the outer circumferential surface of the pin 2*c* and the inner circumferential surface of the piercing hole 3*d*. As shown in FIG. 2, FIG. 4 and FIG. 5, a rotational movement checking device 34 is provided in the room 3*c* of the chest 3 so as to obstruct that the pin 2*c* rotates in the rotating direction B of the rudder-stock 62 against the chest 3, and at the same time, permit that the pin 2*c* displaces in the radial direction of the rudder-stock 62.

The rotational movement checking device 34 is constituted by rotation checking plates 2*d* and a circular ringed elastic member 5 made of rubber, etc. The rotation checking plates 2*d* are provided on the outer circumferential surface of the pin 2*c* so as to be made a pair distributed with 180° angle, and stored in the room 3*c* of the chest 3. The elastic member 5 is divided into two semi-circular elastic fragments 5*a*, 5*b*, and stored in the room 3*c* in such a manner that the respective elastic fragments 5*a*, 5*b* are fitted between the outer circumferential surface of the pin 2*c* and the inner circumferential surface of the cylindrical body 3*a*. Both rotation checking plates 2*d* are set between the elastic fragment 5*a* on the one side and the elastic fragment 5*b* on the other side. Vertical section of both elastic fragments 5*a*, 5*b* is of V-shaped, respectively.

A concave portion 35 is formed on the outer circumferential surface of both elastic fragments 5*a*, 5*b*, respectively, in such a manner that they are caved toward the inside in the radial direction. A convex portion 36 is formed on the inner circumferential surface of the cylindrical body 3*a* of the chest 3 at 2 points in such a manner that they protrude toward the inside in the radial direction. These convex portions 36 are inserted into the concave portions 35, and hence it is obstructed for both elastic fragments 5*a*, 5*b* to rotate against the chest 3 in the rotational direction B of the rudder-stock 62.

Furthermore, as aforementioned, the rotation checking plates 2*d* are set between both elastic fragments 5*a*, 5*b*, and hence it is obstructed for the pin 2*c* to rotate against the chest 3 in the rotational direction B of the rudder-stock 62. Furthermore, by virtue of spreading and shrinking capability of the elastic member 5 in the radial direction, displacement of the pin 2*c* in the radial direction is permissible, as shown by suppositive lines in FIG. 4.

A scale 6 graduated with the equal pitch in the circumferential direction is fitted on the outer circumferential surface of the inner cylindrical body 1. The scale 6 is affixed with graduations 6*a* in the fixed circumferential pitch at equal intervals. Numbers of the pitches of the graduations 6*a* of the scale 6 represents an angle of the rudder 54; namely, if the diameter of the scale 6 in the fitted condition is d, and the pitch of the graduation is p, one pitch of the graduations 6*a* of the scale 6 is equivalent to the rudder angle of 360p/*.

A No. 1 rudder angle detecting optical sensor 7, a No. 2 rudder angle detecting optical sensor 8, a rudder angle transmitting optical sensor 9 and a zero-point detecting optical sensor 10 are fitted on the inner circumferential surface of the outer cylindrical body 2 so as to face the scale 6 with the fixed distance A. In this context, the No. 1 rudder angle detecting optical sensor 7 is for feeding back a rudder angle signal δf to the No. 1 control amplifier 57*a*, the No. 2 rudder angle detecting optical sensor 8 is for feeding back a rudder angle signal δf to the No. 2 control amplifier 57*b*, and the rudder angle transmitting optical sensor 9 is for transmitting a rudder angle signal to the rudder angle indicator 61. Furthermore, the zero-point detecting optical sensor 10 is for detecting the zero-point in order to compensate the respective zero-points of the aforementioned respective optical sensors 7~9, and make them automatically return to the real zero-points when deviation of the zero-points has arisen in the respective optical sensors 7~9. In this context, the rudder angle detecting mechanism is composed of the aforementioned scale 6 and the aforementioned respective optical sensors 7~10.

Figure 6:
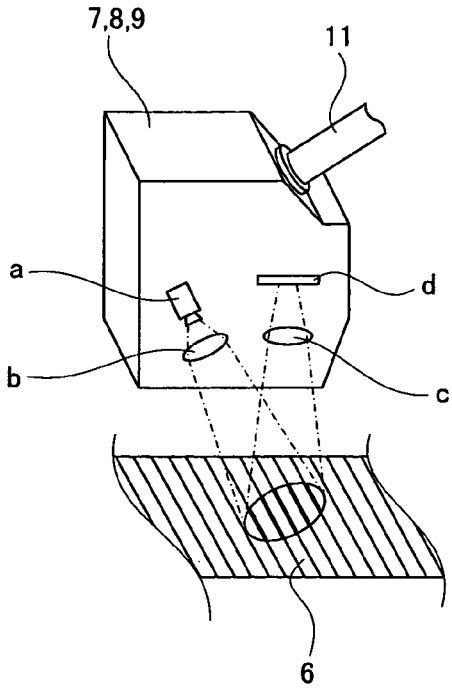
FIG. 6 shows a view showing constitution of respective optical sensor of a rudder angle detecting device in accordance with the first mode for carrying out the present invention.

The No. 1 rudder angle detecting optical sensor 7, the No. 2 rudder angle detecting optical sensor 8 and the rudder angle transmitting optical sensor 9 are respectively composed of a light projection diode a, a light projection lens b, a light reception lens c and a line sensor d, as shown in FIG. 6.

Figure 7:
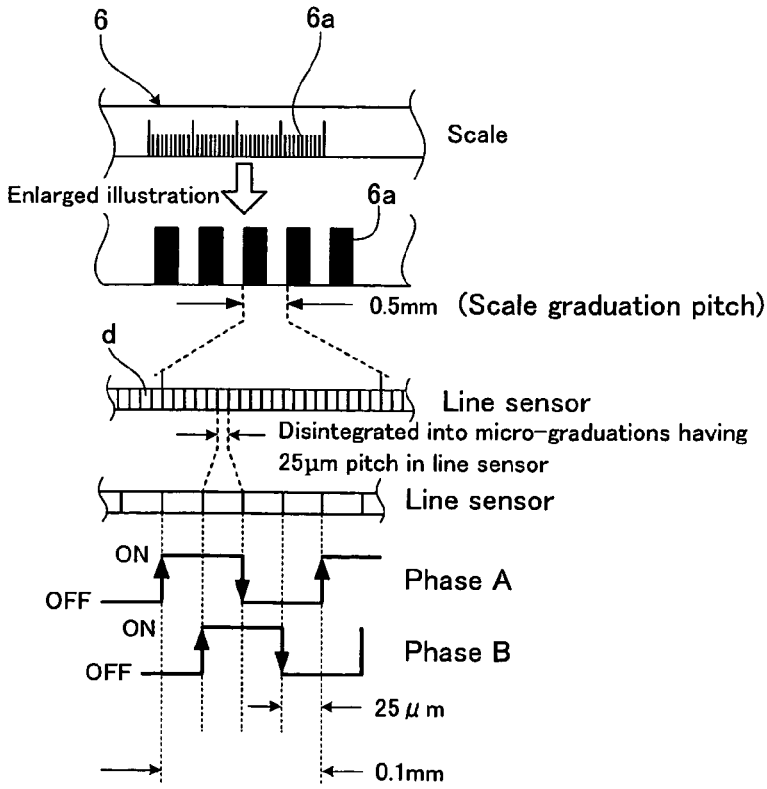
FIG. 7 shows an explanatory view showing relation between a scale of a rudder angle detecting device and a line sensor of a rudder angle detecting optical sensor in accordance with the first mode for carrying out the present invention.

The line sensor d is so devised that, as shown in FIG. 7, one pitch of the graduations 6*a* of the scale 6 (for example 0.5 mm) is minutely divided into 20 pitches for example (namely, one pitch is 25 μm) in order to heighten a degree of reading preciseness, and furthermore, avoid erroneous reading caused by contamination of the scale 6, adherence of foreign substances to the scale 6, etc. Furthermore, in order to detect the direction of reading the scale 6, such a means is taken, for example, that on-off signals are emitted, taking 2 pitches of the line sensor d as the unit, and that these on-off signals are disintegrated into two phases; namely, a base on-off signal phase (a phase A) and a phase B, in which a one pitch phase lag from the base on-off signal phase is given, and such signals are out-put.

Respective input-output cables 11 for detecting a rudder angle that transmit electric signals output from the No. 1 rudder angle detecting optical sensor 7, the No. 2 rudder angle detecting optical sensor 8, the rudder angle transmitting optical sensor 9 and the zero-point detecting optical sensor 10 are led from the inside of the outer cylindrical body 2 to the outside through a cable connector 12 piercing the cylindrical portion of the outer cylindrical body 2, and connected to respective counting integrators 13*a*, 13*b*, 13*c* provided outside. These counting integrators 13*a*, 13*b*, 13*c* conduct counting operation for the electric signals respectively output from the No. 1 rudder angle detecting optical sensor 7, the No. 2 rudder angle detecting optical sensor 8 and the rudder angle transmitting optical sensor 9, and transmit a rudder angle signal δf to the No. 1 control amplifier 57*a* and the No. 2 control amplifier 57*b*, respectively, as feed-back signals for follow-up control, and a rudder angle signal to the rudder angle indicator 61 for indicating the rudder angle.

Furthermore, a group of limit switches is mounted on the inner circumferential surface of the outer cylindrical body 2 for preventing the rudder 54 from moving beyond the rudder angle limits for reasons of disorder of feed-back mechanism, etc. In the following, explanation is made on constitution of the group of the limit switches on a case that the rudder 54 is operated in two modes; that is, a navigation mode, in which the maximum rudder angle limits are set at, for example, 35° or 45° port and 35° or 45° starboard, and a harbor operation mode, in which the maximum rudder angle limits are set at, for example, 70° port and 70° starboard.

As shown in FIG. 2 and FIG. 3, four cams 14*a*, 14*b*, 14*c*, 14*d* are protruded in a line in the up and down direction on the outer circumferential surface of the inner cylindrical body 1 at the location equivalent to zero rudder angle. Out of these, the No. 1 and the No. 2 cams 14*a*, 14*b* are for operating respective limit switches 15*a*, 15*b*, 16*a*, 16*b* to the No. 1 control amplifier 57*a* and the No. 2 control amplifier 57*b* in the navigation mode (for example, at the maximum rudder angle limits of 35° or 45°), and the No. 3 and the No. 4 cams 14*c*, 14*d* are for operating respective limit switches 17*a*, 17*b*, 18*a*, 18*b* to the No. 1 control amplifier 57*a* and the No. 2 control amplifier 57*b* in the harbor operation mode (for example, at the maximum rudder angle limits of 70°).

The aforementioned limit switches 15*a*, 15*b*, 17*a*, 17*b* for the No. 1 control amplifier 57*a* and the limit switches 16*a*, 16*b*, 18*a*, 18*b* for the No. 2 control amplifier 57*b* are mounted on the inner circumferential surface of the outer cylindrical body 2. It is so constituted that, out of these, the first pair of the limit switches 15*a*, 15*b* is operated by the No. 1 cam 14*a* at the location equivalent to 35° (or 45°) port and 35° (or 45°) starboard. It is so constituted that the second pair of the limit switches 16*a*, 16*b* is operated by the No. 2 cam 14*b* at the location equivalent to 35° (or 45°) port and 35° (or 45°) starboard. It is so constituted that the third pair of the limit switches 17*a*, 17*b* is operated by the No. 3 cam 14*c* at the location equivalent to 70° port and 70° starboard. It is so constituted that the fourth pair of the limit switches 18*a*, 18*b* is operated by the No. 4 cam 14*d* at the location equivalent to 70° port and 70° starboard. In this context, the limit switch mechanism is composed of the aforementioned respective limit switches 15*a*~18*a*, 15*b*~18*b* and cams 14*a*~14*d*.

Furthermore, it is so constituted that, when the steering gear 55 is operated by the No. 1 control amplifier 57*a* in the navigation mode, only the first pair of the limit switches 15*a*, 15*b* becomes effective, and when the steering gear 55 is operated by the No. 2 control amplifier 57*b* in the same navigation mode, only the second pair of the limit switches 16*a*, 16*b* becomes effective.

Furthermore, it is so constituted that, when the steering gear 55 is operated by the No. 1 control amplifier 57*a* in the harbor operation mode, only the third pair of the limit switches 17*a*, 17*b* becomes effective, and when the steering gear 55 is operated by the No. 2 control amplifier 57*b* in the same harbor operation mode, only the fourth pair of the limit switches 18*a*, 18*b* becomes effective.

Cables 19 that transmit electric signals output from the group of the limit switches 15*a*~18*a*, 15*b*~18*b* are connected to the No. 1 control amplifier 57*a* and the No. 2 control amplifier 57*b* through a cable connector 20 piercing the cylindrical portion of the outer cylindrical body 2.

Function in the aforementioned constitution is described in the following:

When the rudder-stock 62 rotates, the inner cylindrical body 1 also rotates together with the rudder-stock 62. On this occasion, the pin 2*c* is obstructed to rotate by the rotational movement checking device 34, and hence the outer cylindrical body 2 is obstructed to rotate together with the pin 2*c*, and fixed to the side of the casing top cover 67 through the chest 3. Furthermore, the gudgeon 1*c* of the inner cylindrical body 1 slidingly contacts the gudgeon pin 2*b*, and at the same time, the collar 1*d* of the inner cylindrical body 1 slidingly contacts the inner surface of the outer cylindrical body 2, and hence relative position of the outer cylindrical body 2 to the inner cylindrical body 1 is kept constant. Accordingly, regardless of rotation of the rudder-stock 62, a gap between the respective optical sensors 7~10 and the scale 6 is kept at the invariable fixed distance A, and that positional relation between the group of the limit switches 15*a*~18*a*, 15*b*~18*b* and the cams 14*a*~14*d* is also invariable.

Furthermore, in case that the axis of the rudder-stock 62 deviates from the center of the casing top cover 67 in the radial direction, and the rudder-stock 62 suffers off-centering motion, the inner cylindrical body 1 is displaced in the radial direction together with the rudder-stock 62, and, as shown by the suppositive lines in FIG. 4, the pin 2*c* displaces in the radial direction of the rudder-stock 62 together with the outer cylindrical body 2. On this occasion, the displacement of the pin 2*c* in the radial direction is permissible by means that the elastic member 5 is elastically deformed, being pushed by the pin 2*c*. By virtue of this, the off-centering motion of the rudder-stock 62; namely, the off-centering motion of the inner cylindrical body 1 and the outer cylindrical body 2, is permissible against the supports 4 fixated to the casing top cover 67, and that the gaps between the scale 6 and the respective optical sensors 7~10 are always kept at the fixed interval A since the inner cylindrical body 1 and the outer cylindrical body 2 together displace in the radial direction of the rudder-stock 62, corresponding to the eccentricity of the rudder-stock 62. Accordingly, regardless of off-centering motion of the rudder-stock 62, it is possible to detect a rudder angle correctly, and that there is no case that the relative relation between the inner cylindrical body 1 and the outer cylindrical body 2 is affected by the eccentricity. Furthermore, there is no case that the off-centering motion of the rudder-stock 62 brings the rudder angle detecting device 40 mechanical compulsion.

When the rudder 54; namely, the rudder-stock 62, is situated in the neutral position, the zero-point detecting optical sensor 10 detects the zero-point of the scale 6, and, in compliance with this zero-point signal, the respective zero-points for the No. 1 rudder angle detecting optical sensor 7, the No. 2 rudder angle detecting optical sensor 8 and the rudder angle transmitting optical sensor 9 in the respective counting integrators 13*a*, 13*b*, 13*c* are established.

In this condition, when the rudder 54 starts rotation in the ordered direction in compliance with a command of the autopilot steering apparatus 51, the No. 1 rudder angle detecting optical sensor 7, the No. 2 rudder angle detecting optical sensor 8 and the rudder angle transmitting optical sensor 9 respectively detect a moving (passing) graduation 6*a* of the scale 6 of the inner cylindrical body 1 rotating together with the rudder-stock 62 through, as shown in FIG. 6 and FIG. 7, the light projecting diode a, the light projecting lens b, the light reception lens c and the line sensor d. The counting integrators 13*a*, 13*b*, 13*c* integrate numbers of moved (passed) graduations by detected signals output from the respective optical sensors 7~9, convert the integrated counts into a rudder angle, and respectively output as a rudder angle signal. Then, rudder angle signals respectively detected by the No. 1 rudder angle detecting optical sensor 7 and the No. 2 rudder angle detecting optical sensor 8 are fed to the No. 1 control amplifier 57*a* and the No. 2 control amplifier 57*b*, respectively, as a rudder angle feed-back signal δf, and the rudder angle signal detected by the rudder angle transmitting optical sensor 9 is fed to the rudder angle indicator 61.

Furthermore, with respect to detection of rotating direction of the rudder 54, such a measure is taken that, as the respective output signals from the No. 1 rudder angle detecting optical sensor 7, the No. 2 rudder angle detecting optical sensor 8 and the rudder angle transmitting optical sensor 9 are, as shown in FIG. 7, disintegrated into two phases: the base on-off signal phase (the phase A) and the phase B, in which a one pitch phase lag from the base on-off signal phase (the phase A) is given, when the rudder 54 is in the counterclockwise rotation, combined reading for the phase A and the phase B in passage of the graduations 6*a* of the scale 6 becomes such that, for example, after the phase A is at "on" and the phase B is at "on", the phase B comes to be at "off", with the phase A being kept at "on". When the rudder 54 is in the clockwise rotation, combined reading for the phase A and the phase B in passage of the graduations 6*a* of the scale 6 becomes such that, for example, after the phase A is at "on" and the phase B is at "on", the phase A comes to be at "off", with the phase B being kept at "on". Thus rotative direction of the rudder 54 can be detected based on such difference in combined reading of the phase A and the phase B.

In this context, at each time when the rudder 54; namely, the rudder-stock 62, passes the neutral position, the zero-point detecting optical sensor 10 detects the zero-point, and the respective zero-points of the No. 1 rudder angle detecting optical sensor 7, the No. 2 rudder angle detecting optical sensor 8 and the rudder angle transmitting optical sensor 9 are automatically compensated and return to their respective zero-points, if they have been deviated, by the signal detected by the zero-point detecting optical sensor 10, and at the same time, generation of detecting errors by accumulation of counting errors is reduced.

In the next place, explanation is made on function of the group of the limit switches 15*a*~18*a*, 15*b*~18*b*.

In case that, for example, the steering gear 55 is operated by the No. 1 control amplifier 57*a*, and under the navigation mode, in which the maximum rudder angle limits are confined to 35° (or 45°) port and 35° (or 45°) starboard, when the No. 1 cam 14*a* contacts the one-side limit switch 15*a* or the other-side limit switch 15*b* of the first pair by rotation of the inner cylindrical body 1 together with the rudder-stock 62, the one-side limit switch 15*a* or the other-side limit switch 15*b* of the first pair is changed-over into "on", and it is detected that a rudder angle has come to the maximum rudder angle limit. Based on this detection, the No. 1 control amplifier 57*a* stops the rudder-stock 62 so that it does not move beyond the maximum rudder angle limit.

Furthermore, in case that the steering gear 55 is operated by the No. 2 control amplifier 57*b*, and under the same navigation mode, when the No. 2 cam 14*b* contacts the one-side limit switch 16*a* or the other-side limit switch 16*b* of the second pair by rotation of the inner cylindrical body 1 together with the rudder-stock 62, the one-side limit switch 16*a* or the other-side limit switch 16*b* of the second pair is changed-over into "on", and it is detected that a rudder angle has come to the maximum rudder angle limit. Based on this detection, the No. 2 control amplifier 57*b* stops the rudder-stock 62 so that it does not move beyond the maximum rudder angle limit.

Furthermore, in case that the steering gear 55 is operated by the No. 1 control amplifier 57*a*, and under the harbor operation mode, in which the maximum rudder angle limits are confined to 70° port and 70° starboard, when the No. 3 cam 14*c* contacts the one-side limit switch 17*a* or the other-side limit switch 17*b* of the third pair by rotation of the inner cylindrical body 1 together with the rudder-stock 62, the one-side limit switch 17*a* or the other-side limit switch 17*b* of the third pair is changed-over into "on", and it is detected that a rudder angle has come to the maximum rudder angle limit. Based on this detection, the No. 1 control amplifier 57*a* stops the rudder-stock 62 so that it does not move beyond the maximum rudder angle limit.

Furthermore, in case that the steering gear 55 is operated by the No. 2 control amplifier 57*b*, and under the same harbor operation mode, when the No. 4 cam 14*d* contacts the one-side limit switch 18*a* or the other-side limit switch 18*b* of the fourth pair by rotation of the inner cylindrical body 1 together with the rudder-stock 62, the one-side limit switch 18*a* or the other-side limit switch 18*b* of the fourth pair is changed-over into "on", and it is detected that a rudder angle has come to the maximum rudder angle limit. Based on this detection, the No. 2 control amplifier 57*b* stops the rudder-stock 62 so that it does not move beyond the maximum rudder angle limit.

When the casing top cover 67 is removed for overhaul inspection of the steering gear 55, the casing top cover 67 can be removed by only removing the supports 4 of the rudder angle detecting device 40 from the chest 3 and the casing top cover 67, with the other rudder angle detecting mechanism and the limit switch mechanism being left as it is. And, after the casing top cover 67 has been remounted, and the supports 4 have been remounted to the chest 3 and the casing top cover 67, there is no need of readjustment of the rudder angle detecting mechanism while conventional rudder angle detecting mechanism necessitates readjustment troublesomely.

Furthermore, when the nut 64 that fixates the binding between the rudder-stock 62 and the steering gear rotor 63 is detached and attached, the nut 64 can be removed by means that the supports 4 of the rudder angle detecting device 40 are removed from the casing top cover 67, and that the remaining whole rudder angle detecting device 40 is removed from the rudder-stock 62. And, after the nut 64 has been remounted, the supports 4 have been remounted, and the remaining whole rudder angle detecting device 40 has been remounted to the rudder-stock 62, there is no need of readjustment of the rudder angle detecting mechanism while conventional rudder angle detecting mechanism necessitates readjustment troublesomely.

As explained above, in accordance with the mode for carrying out the present invention, thanks to such constitution that, in the rudder angle detecting device 40 of the steering gear 55, the scale 6 and the respective optical sensors 7~10 that constitute the rudder angle detecting mechanism, and the group of the limit switches 15*a*~18*a*, 15*b*~18*b* and the group of the cams 14*a*~14*d* that constitute the limit switch mechanism are all stored inside the outer cylindrical body 2, dispensing with the exteriorly protruding moving portions from the steering gear 55, while exteriorly protruding moving portions are indispensable in conventional constitution, safe operation becomes possible, and that, the steering gear 55 becomes excellent in aesthetic sense because its external form becomes a simple columnar body as a whole. Furthermore, thanks to such constitution that the respective constitutive elements of the rudder angle detecting device 40 are not exposed to the outside, they become hard to be affected by contaminated environment, and that such an occasion that they fall into ill-operation by reason of an accidental mechanical blow sustained during work, etc. is decreased.

Furthermore, thanks to such constitution that detection of a rudder angle is conducted by means of integrative reading of the graduations 6*a* of the scale 6 by the respective optical sensors 7~9, there is no case that the precision of detecting a rudder angle varies with magnitude of a rudder angle, and that hardness of large rudder angle detection, that is unavoidable in conventional mechanism, can be removed.

And, when the casing top cover 67 is removed for overhaul inspection of the steering gear 55, the casing top cover 67 can be removed by means of removing only the supports 4 of the rudder angle detecting device 40, with the other portions of the rudder angle detecting device 40 being left as it is. Furthermore, when the nut 64 fixating the binding between the rudder-stock 62 and the steering gear rotor 63 is removed/remounted, it is possible for the nut 64 to be removed by means that the supports 4 of the rudder angle detecting device 40 are removed from the casing top cover 67, and that all the other portions of the rudder angle detecting device 40 are removed from the rudder-stock 62 as a whole. And, in either case of the abovementioned, it is not necessary to conduct such readjustment to the rudder angle detecting mechanism as to be required troublesomely in conventional rudder angle detecting mechanism after the casing top cover 67 has been remounted, or the nut 64 has been remounted, and then the rudder angle detecting device 40 has been remounted.

In the aforementioned first mode for carrying out the present invention, the maximum rudder angle limits of the rudder 54 of 35° (or 45°) or 70° port and starboard are cited as an example, they are not limited to these rudder angles, and capable of assigning other rudder angles than the abovementioned to the maximum rudder angle limits.

In the aforementioned first mode for carrying out the present invention, the pin 2*c* is provided with two rotation checking plates 2*d*, but it is capable that it is provided with plural rotation checking plates other than two, or single rotation checking plate. Furthermore, in the aforementioned first mode for carrying out the present invention, the elastic member 5 is divided into two elastic fragments 5*a*, 5*b*, but it is capable that it is divided into plural elastic fragments other than two. Otherwise, such a manner that a part of the elastic member 5 is separated is acceptable.

In the next place, the second mode for carrying out the present invention is explained in the following on the basis of FIG. 8, FIG. 9A and FIG. 9B.

Figure 8:
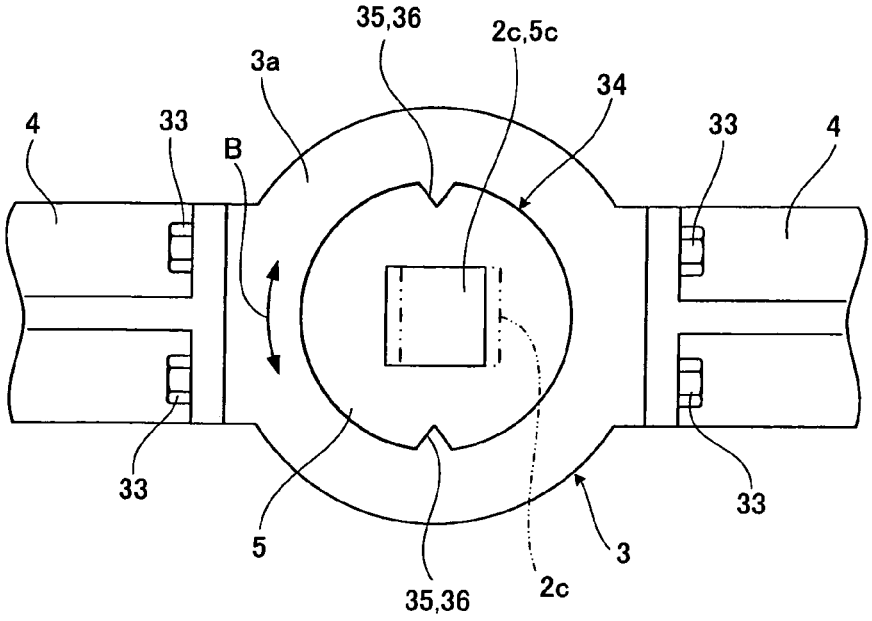
FIG. 8 shows an enlarged plane view of a chest portion of a rudder angle detecting device of a steering gear in accordance with the second mode for carrying out the present invention.
Figure 9A:
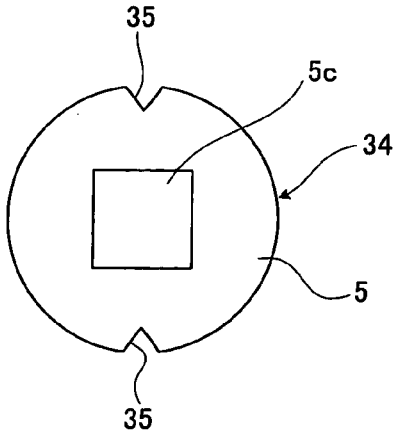
FIG. 9A shows a plane view of an elastic member of a rotational movement checking device of a rudder angle detecting device in accordance with the second mode for carrying out the present invention.
Figure 9B:
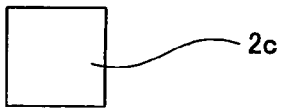
FIG. 9B shows a plane view of a pin of a rotational movement checking device of a rudder angle detecting device in accordance with the second mode for carrying out the present invention.
Figure 10:
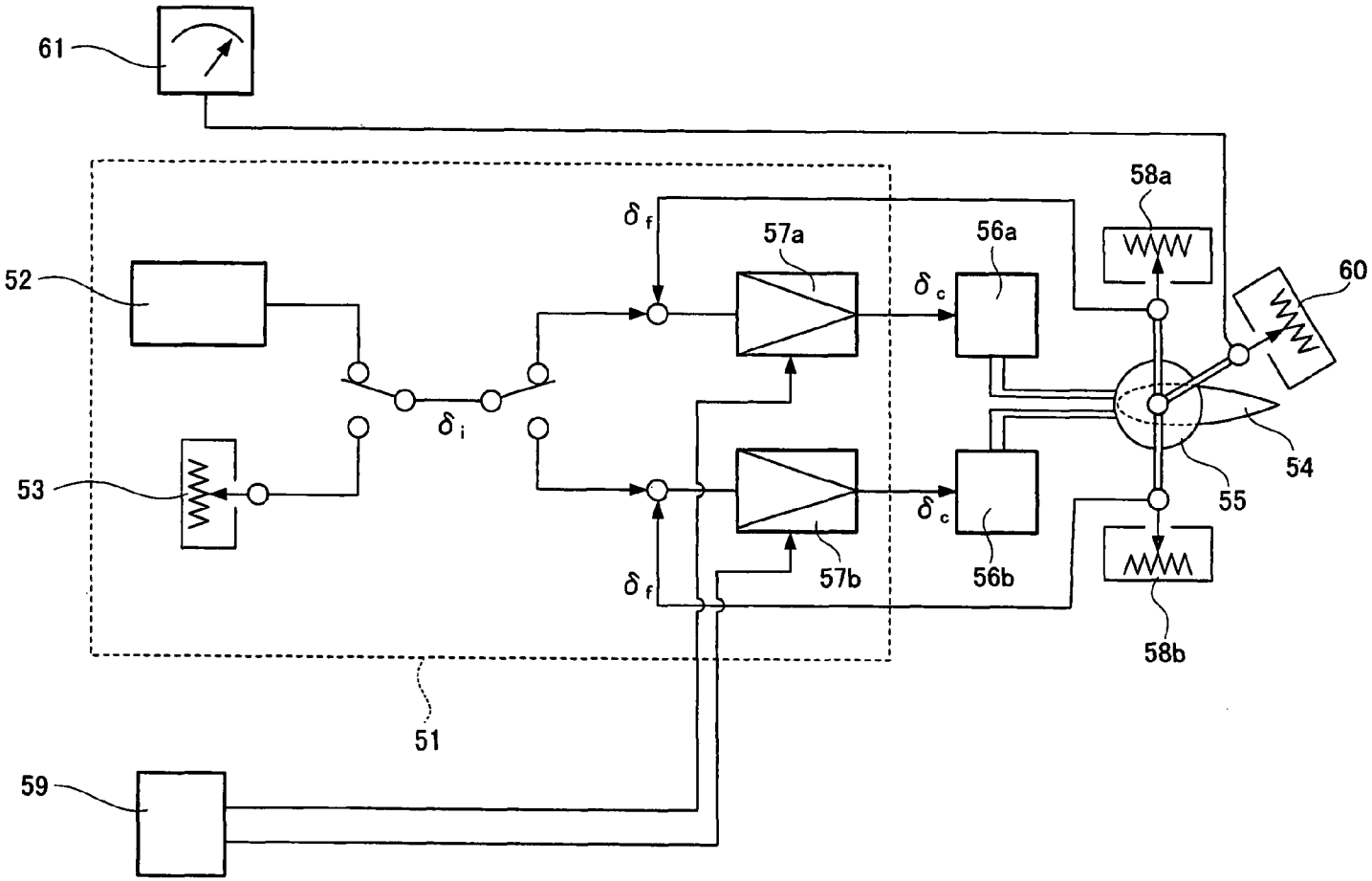
FIG. 10 PRIOR ART
FIG. 10 shows a block diagram showing a control system of a steering gear of a prior art.
Figure 11:
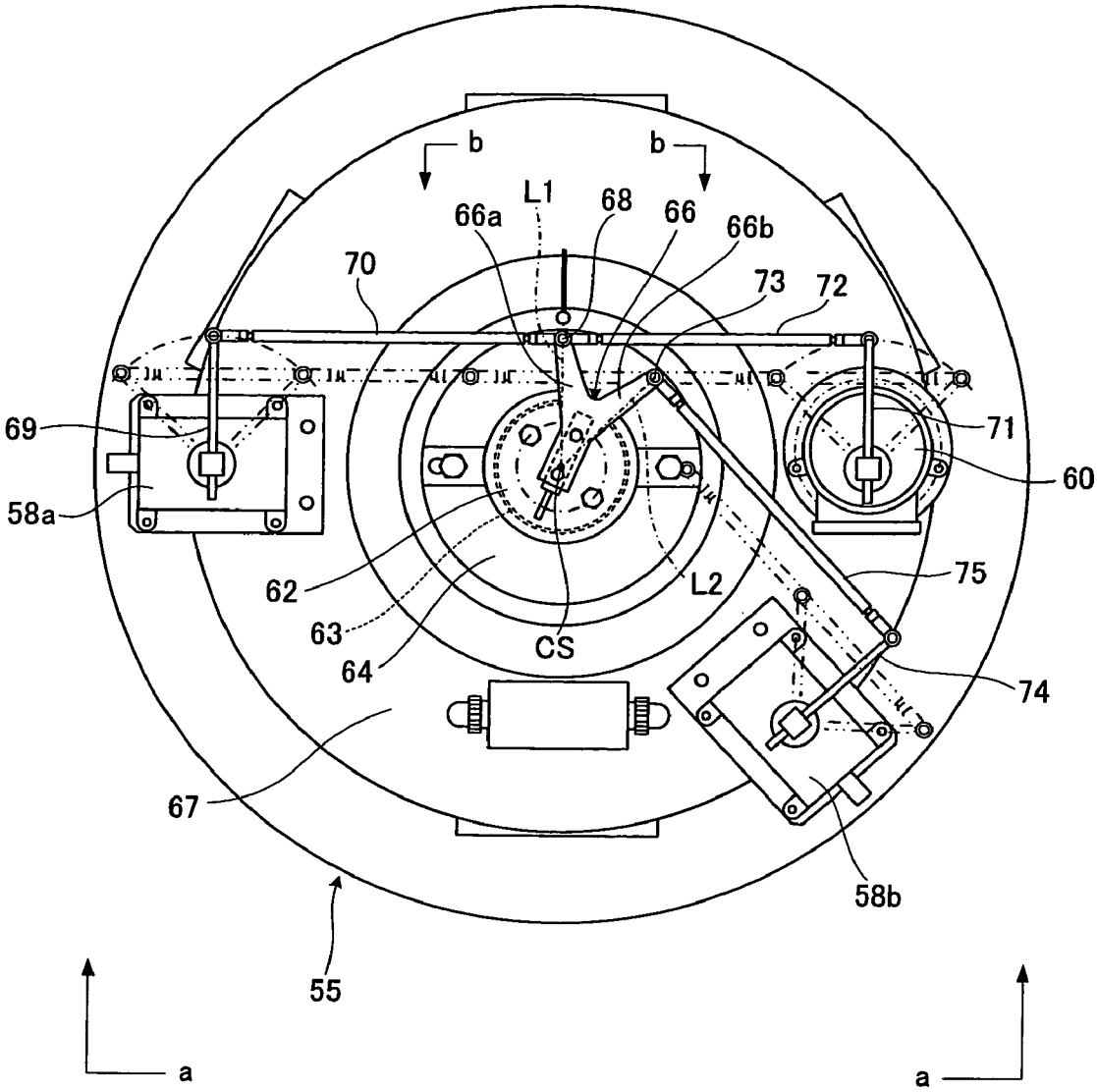
FIG. 11 PRIOR ART
FIG. 11 shows a plane view of a rudder angle detecting device of a steering gear of a prior art.
Figure 12:
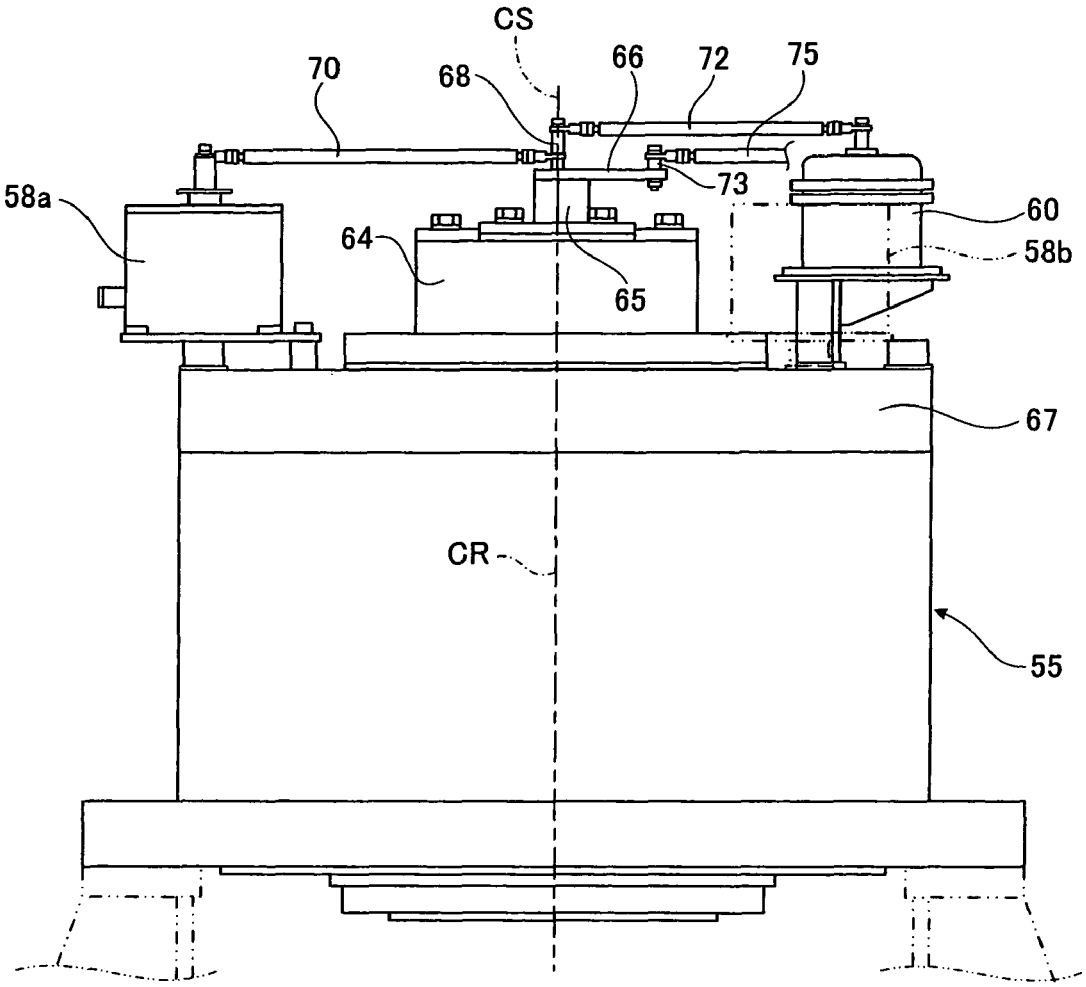
FIG. 12 PRIOR ART
FIG. 12 shows a front view, seen along the arrows a-a in FIG. 11 aforementioned.
Figure 13:
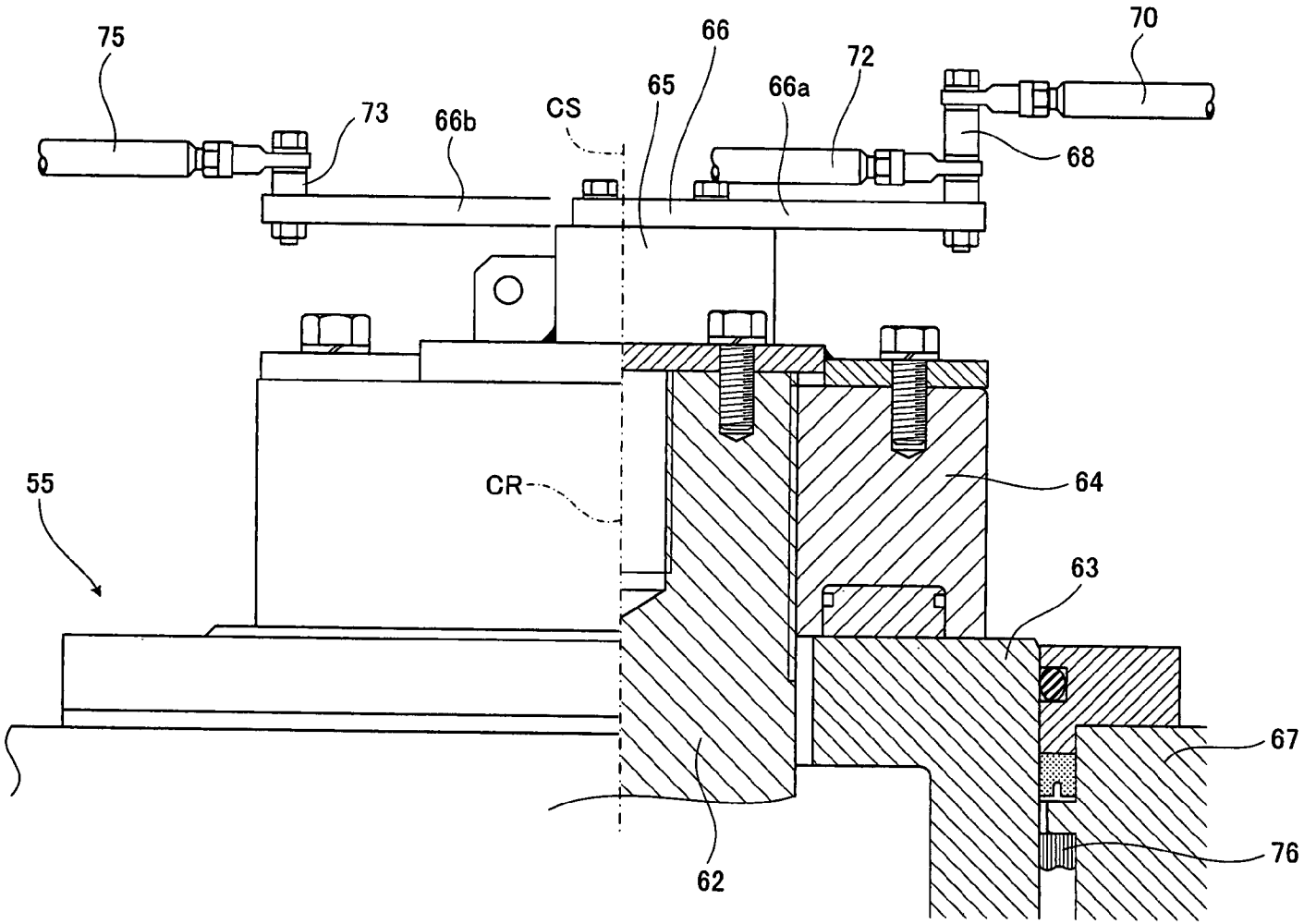
FIG. 13 PRIOR ART
FIG. 13 shows a partially sectioned view, seen along the arrows b-b in FIG. 11 aforementioned.

As shown in FIG. 8, FIG. 9A and FIG. 9B, cross-section of a pin 2*c* forms quadrangle. And, a rotational movement checking device 34 consists of a circular ringed elastic member 5 having a square hole 5*c* of quadrangle that pierces the central portion. Rubber material etc. is used for the elastic member 5. The elastic member 5 is stored in the room 3*c* of the chest 3, and vertical section of the elastic member 5 is of V-shaped. The pin 2*c* is loosely penetrated into the piercing hole 3*d* of the chest 3 from the lower side, and inserted into the square hole 5*c* of the elastic member 5.

On the outer circumferential surface of the elastic member 5, plural concave portions 35 caved toward the inside in the radial direction are formed. On the inner circumferential surface of the cylindrical body 3*a* of the chest 3, plural convex portions 36 protruded toward the inside in the radial direction are formed. These convex portions 36 are fitted into the concave portions 35, and by means of this, it is obstructed that the elastic member 5 rotates in the rotating direction B of the rudder-stock 62 against the chest 3.

And as abovementioned, the pin 2*c* having the quadrangle cross-sectional profile is inserted into the square hole 5*c*, and hence it is obstructed that the pin 2*c* rotates in the rotating direction B of the rudder-stock 62 against the chest 3. Furthermore, by virtue of expansibility and contractivity of the elastic member 5 in the radial direction, as shown by the suppositive lines in FIG. 8, displacement of the pin 2*c* in the radial direction is allowed.

In accordance with this, in case that the rudder-stock 62 rotates, the inner cylindrical body 1 also rotates together with the rudder-stock 62, and on this occasion, the pin 2*c* is obstructed to rotate by the rotational movement checking device 34, and hence the outer cylindrical body 2 is also obstructed to rotate together with the pin 2*c*, and fixed to the side of the casing top cover 67 through the chest 3.

Furthermore, when the rudder-stock 62 suffers off-centering motion, the inner cylindrical body 1 is displaced in the radial direction together with the rudder-stock 62, and the pin 2*c* displaces in the radial direction of the rudder-stock 62 together with the outer cylindrical body 2. On this occasion, as shown by the suppositive lines in FIG. 8, the displacement of the pin 2*c* in the radial direction is permissible by means that the elastic member 5 is elastically deformed, being pushed by the pin 2*c*. By virtue of this, the off-centering motion of the rudder-stock 62; namely, the off-centering motion of the inner cylindrical body 1 and the outer cylindrical body 2, is permissible against the supports 4 fixated to the casing top cover 67, and that the gaps between the scale 6 and the respective optical sensors 7~10 are always kept at the fixed interval A since the inner cylindrical body 1 and the outer cylindrical body 2 together displace in the radial direction of the rudder-stock 62, corresponding to the eccentricity of the rudder-stock 62. Accordingly, regardless of off-centering motion of the rudder-stock 62, it is possible to detect a rudder angle correctly, and that there is no case that the relative relation between the inner cylindrical body 1 and the outer cylindrical body 2 is affected by the eccentricity. Furthermore, there is no case that the off-centering motion of the rudder-stock 62 brings the rudder angle detecting device 40 mechanical compulsion.

In the aforementioned second mode for carrying out the present invention, the cross-section of the pin 2*c* and the square hole 5*c* of the elastic member 5 are formed quadrangularly, but such a manner is acceptable that they are formed of a polygon other than quadrangle.

In the aforementioned first and second modes for carrying out the present invention, as shown in FIG. 4 and FIG. 8, the concave portion 35 is formed on the elastic member 5, and the convex portion 36 is formed on the chest 3, but such a manner is acceptable that the concave portion 35 is formed on the inner circumferential surface of the cylindrical body 3*a* of the chest 3, and the convex portion 36 is formed on the outer circumferential surface of the elastic member 5.

As aforementioned, the rudder angle detecting device of the steering gear concerned with the present invention is able to cope with steering gears of various size, only with size of the supports being altered, since it is unrelated to capacity (size) of a steering gear. Accordingly, it is suitable for various ships from large ships such as crude oil carriers, etc. to small-sized vessels. Furthermore, it is able to be applied to not only rotary vane type steering gears, but also steering gears of other type.

What is claimed is:

1. A rudder angle detecting device of a steering gear characterized in that:

an inner cylindrical body is mounted on the top surface of a rudder-stock coaxially with the rudder-stock;

an outer cylindrical body is put on the inner cylindrical body exteriorly;

a rotational movement checking device is provided for obstructing rotational movement of the outer cylindrical body in the direction of rotation of the rudder-stock;

a scale is provided on the outer circumferential surface of the inner cylindrical body;

the scale is provided with graduations in the fixed circumferential pitch; and rudder angle detecting optical sensors that read the graduations are mounted on the inner circumferential surface of the outer cylindrical body.

2. A rudder angle detecting device of a steering gear in accordance with Patent claim 1, characterized in that:

a gudgeon is provided on the top surface of the inner cylindrical body;

the gudgeon holds a concave portion;

a collar is protruded on the lower outer circumferential surface of the inner cylindrical body;

a gudgeon pin is provided in the center of the top reverse surface of the outer cylindrical body;

the gudgeon pin is inserted into the concave portion of the gudgeon, and slidingly contacts with the gudgeon in the circumferential direction;

the outer circumferential surface of the collar slidingly contacts with the inner circumferential surface of the outer cylindrical body;

supports are mounted on a casing top cover of a steering gear;

a cylindrical chest is mounted at the end of the supports, coaxially with the casing top cover;

a pin is protruded in the center of the top surface of the outer cylindrical body so that it is inserted into the chest; and the said rotational movement checking device is provided inside the chest so that it obstructs the said pin to rotate against the chest in the rotating direction of a rudder-stock, and at the same time, permits the said pin to be displaced in the radial direction of the rudder-stock.

3. A rudder angle detecting device of a steering gear in accordance with Patent claim 1, characterized in that:

a rudder angle transmitting optical sensor and a zero-point detecting optical sensor are mounted on the inner circumferential surface of an outer cylindrical body;

the rudder angle detecting optical sensors, the rudder angle transmitting optical sensor and the zero-point detecting optical sensor face the scale at the fixed intervals; and counting integrators that integrate numbers of passed graduations read by the aforementioned respective optical sensors, and transform to a rudder angle signal, are connected with the aforementioned respective optical sensors through input-output cables and a cable connector provided on the outer cylindrical body.

4. A rudder angle detecting device of a steering gear in accordance with Patent claim 1, characterized in that:

cams are provided on the outer circumferential surface of the inner cylindrical body in the location corresponding to the zero rudder angle;

limit switches are mounted on the inner circumferential surface of the outer cylindrical body in the locations corresponding to the maximum rudder angle limits; and the limit switches are actuated by the cams when rudder angles reach the maximum rudder angle limits.

* * * * *